US012782011B2

(12) United States Patent
Zhang et al.

(10) Patent No.: US 12,782,011 B2
(45) Date of Patent: Nov. 3, 2026

(54) REFRIGERATION SYSTEM AND REFRIGERATION DEVICE

(71) Applicant: ANHUI MEIZHI COMPRESSOR CO., LTD., Hefei (CN)

(72) Inventors: Yangyang Zhang, Hefei (CN); Zihan Yan, Hefei (CN); Kun Wang, Hefei (CN); Juan Li, Hefei (CN); Tao Ma, Hefei (CN); Gang Huang, Hefei (CN)

(73) Assignee: ANHUI MEIZHI COMPRESSOR CO., LTD., Hefei (CN)

( * ) Notice: Subject to any disclaimer, the term of this patent is extended or adjusted under 35 U.S.C. 154(b) by 49 days.

(21) Appl. No.: 18/807,088

(22) Filed: Aug. 16, 2024

(65) Prior Publication Data

US 2024/0401853 A1 Dec. 5, 2024

Related U.S. Application Data

(63) Continuation of application No. PCT/CN2022/095995, filed on May 30, 2022.

(30) Foreign Application Priority Data

Feb. 18, 2022 (CN) ..... 202210155536.5
Feb. 18, 2022 (CN) ..... 202220372515.4

(51) Int. Cl.
*F25B 41/20* (2021.01)
*F25B 5/02* (2006.01)

(52) U.S. Cl.
CPC ..... *F25B 41/20* (2021.01); *F25B 5/02* (2013.01)

(58) Field of Classification Search
CPC .... F25B 41/20; F25B 5/02; F25B 2600/2507; F25B 31/023; F25B 1/02; F25B 41/37;
(Continued)

(56) References Cited

U.S. PATENT DOCUMENTS

2008/0190125 A1* 8/2008 Yoshioka ..... F25B 5/02 62/503
2013/0098081 A1* 4/2013 Cur ..... F25D 11/022 165/104.21
(Continued)

FOREIGN PATENT DOCUMENTS

AU 2008205992 A1 * 7/2008 ..... F04C 28/185
CN 101251282 A 8/2008
(Continued)

OTHER PUBLICATIONS

Extended European search report dated Mar. 10, 2025 received in European Patent Application No. 22926640.8.
(Continued)

*Primary Examiner* — Kun Kai Ma
(74) *Attorney, Agent, or Firm* — Anova Law Group, PLLC

(57) ABSTRACT

A refrigeration system and a refrigeration device are provided. The refrigeration system includes a circulation circuit. The circulation circuit includes a main flow path, and a first branch and a second branch that are connected to the main flow path and are connected in parallel. The main flow path is provided with a condenser and a compressor. The condenser has an output end in communication with an end of the first branch and an end of the second branch. The compressor has two suction holes in communication with another end of the first branch and another end of the second branch, respectively. The first branch and the second branch are provided with a first evaporator and a second evaporator, respectively.

10 Claims, 5 Drawing Sheets

(58) Field of Classification Search
CPC ..... F25B 41/31; F04B 39/023; F04B 39/10; F04B 39/1073; F04B 39/122; F25D 11/022
See application file for complete search history.

(56) References Cited

U.S. PATENT DOCUMENTS

| | | | | |
|---|---|---|---|---|
| 2018/0258922 | A1* | 9/2018 | Ascani | F25B 31/023 |
| 2019/0178557 | A1* | 6/2019 | Chung | F25D 29/00 |

FOREIGN PATENT DOCUMENTS

| | | | | | |
|---|---|---|---|---|---|
| CN | 102116184 | A | | 7/2011 | |
| CN | 105004100 | A | | 10/2015 | |
| CN | 107407265 | A | | 11/2017 | |
| CN | 208475718 | U | | 2/2019 | |
| CN | 110762580 | A | | 2/2020 | |
| CN | 212962310 | U | | 4/2021 | |
| CN | 113091340 | A | | 7/2021 | |
| CN | 215951838 | U | | 3/2022 | |
| CN | 216814667 | U | | 6/2022 | |
| CN | 216897884 | U | | 7/2022 | |
| CN | 216897887 | U | | 7/2022 | |
| CN | 216897888 | U | | 7/2022 | |
| CN | 221099024 | U | | 6/2024 | |
| CN | 221099027 | U | | 6/2024 | |
| EP | 3230587 | B1 | | 10/2021 | |
| JP | H04255581 | A | | 9/1992 | |
| JP | 2001295756 | A | * | 10/2001 | F04B 39/102 |
| JP | 2001295757 | A | * | 10/2001 | F04B 27/1063 |
| JP | 2005164070 | A | | 6/2005 | |
| JP | 2005214483 | A | * | 8/2005 | |
| JP | 2005214489 | A | * | 8/2005 | |
| JP | 2007176302 | A | | 7/2007 | |
| JP | 2009156207 | A | * | 7/2009 | |
| JP | 2017538070 | A | | 12/2017 | |

OTHER PUBLICATIONS

Notice of Reasons for Refusal dated Aug. 19, 2025 received in Japanese Patent Application No. 2024-543969.
International Search Report dated Nov. 18, 2022 issued in PCT/CN2022/095995, 6 pages.
Written Opinion dated Nov. 18, 2022 issued in PCT/CN2022/095995, 8 pages.
Office Action dated Dec. 2, 2025 received in Chinese Patent Application No. 202210155536.5.
Decision of Refusal dated Feb. 3, 2026 received in Japanese patent Application No. 2024-543969.
Jin, Z., "Compressor", Chemical Industry Press, No. 103358, ISBN 7-5025-9275-X, 2006, pp. 142-147.
The China National Intellectual Property Administration (CNIPA) The Second Office Action for Chinese Application 202210155536.5 Mar. 28, 2026 10 Pages (With Translation).
Korean Intellectual Property Office (KIPO) The Request for the Submission of an Opinion For KR Application No. 10-2024-7027219 May 10, 2026 12 Pages (With Translation).

* cited by examiner

REFRIGERATION SYSTEM AND REFRIGERATION DEVICE

CROSS-REFERENCE TO RELATED APPLICATIONS

This application is a continuation application of International Application No. PCT/CN2022/095995 filed on May 30, 2022, which claims priority to Chinese Patent Applications Nos. 202210155536.5 and 202220372515.4 filed on Feb. 18, 2022, the entire contents of each of which are incorporated herein by reference for all purposes. No new matter has been introduced.

FIELD

The present disclosure relates to the field of refrigeration system technologies, and more particularly, to a refrigeration system and a refrigeration device.

BACKGROUND

Existing refrigeration device, such as a refrigerator and a freezer, and a reciprocating compressor have experienced decades of development, resulting in that the existing refrigeration device has a high degree of technical maturity and a performance level of the existing refrigeration device also tends to bottleneck. Faced with a substantial upgrade of the refrigeration industry in the future, there is a lack of innovative and breakthrough technological progress. For example, some existing independent double-cycle refrigerators use two compressors and two corresponding sets of independent refrigeration devices and controls. This simple combination, which only meets basic functions, leads to high costs of the whole machine and unsatisfactory system integration.

SUMMARY

An embodiment of the present disclosure provides a refrigeration system and a refrigeration device. The refrigeration system employing a dual-suction compressor and equipped with double evaporators can meet a need for more functions and higher performance.

To achieve the above embodiment, the present disclosure provides a refrigeration system. The refrigeration system includes a circulation circuit. The circulation circuit includes a main flow path, and a first branch and a second branch that are connected to the main flow path and are connected in parallel. The main flow path is provided with a condenser and a compressor. The condenser has an output end in communication with an end of the first branch and an end of the second branch. The compressor has two suction holes in communication with another end of the first branch and another end of the second branch, respectively. The first branch and the second branch are provided with a first evaporator and a second evaporator, respectively.

In an embodiment, the compressor includes: a cylinder body having a working chamber, the working chamber having a first suction hole at a bottom of the working chamber and a second suction hole at a side wall of the working chamber, and the first suction hole and the second suction hole being in communication with the first branch and the second branch, respectively; and a piston assembly comprising a piston movably disposed in the working chamber, the piston having a first dead center at the bottom of the working chamber and a second dead center away from the bottom of the working chamber during an operation stroke of the piston.

In an embodiment, a distance between the second suction hole and the first dead center is L, and a distance between the first dead center and the second dead center is S, where $0.5S<L$.

In an embodiment, a suction pressure of the first suction hole is less than a suction pressure of the second suction hole; and a temperature of the first evaporator is lower than a temperature of the second evaporator.

In an embodiment, a temperature of the second evaporator is $T1$, and a temperature of the first evaporator is $T2$, where $0 \leq T1-T2 \leq 25°$ C.

In an embodiment, $-15°$ C.$\leq T1 \leq 0°$ C., $-30°$ C.$\leq T2 \leq -15°$ C., and $10 \leq T1-T2 \leq 20°$ C.

In an embodiment, the refrigeration system further includes at least one diverter valve disposed at a connection between the first branch, the second branch, and the main flow path; or at least one of the first branch and the second branch is provided with a control valve.

In an embodiment, the refrigeration system further includes two throttling elements disposed at the first branch and the second branch, respectively. One of the two throttling elements is located between the condenser and the first evaporator. Another of the two throttling elements is located between the condenser and the second evaporator.

In an embodiment, each of the two throttling elements is a capillary tube or an expansion valve.

The present disclosure further provides a refrigeration device. The refrigeration device includes the above-mentioned refrigeration system. The refrigeration system includes the circulation circuit. The circulation circuit includes the main flow path, and the first branch and the second branch that are connected to the main flow path and are connected in parallel. The main flow path is provided with the condenser and the compressor. The condenser has the output end in communication with the end of the first branch and the end of the second branch. The compressor has the two suction holes in communication with the other end of the first branch and the other end of the second branch, respectively. The first branch and the second branch are provided with the first evaporator and the second evaporator, respectively.

In an embodiment, the refrigeration device is a refrigerator.

In the technical solutions of the present disclosure, the first evaporator and the second evaporator can be independent of each other through two independent suction channels in the compressor, and thus an overall efficiency of the refrigeration system becomes higher. Specifically, the first branch and the second branch can realize simultaneous circulation from the first evaporator and the second evaporator under a dual-suction structure of the compressor, in such a manner that the two evaporators operate simultaneously, enhancing a refrigeration capacity of the system. Compared with a conventional refrigeration system having a single-suction single-discharge compressor and series-parallel double evaporators, the refrigeration system of the present disclosure has a larger refrigeration capacity and higher refrigeration performance, better meeting future technical requirements.

BRIEF DESCRIPTION OF THE DRAWINGS

In order to clearly explain technical solutions according to the embodiments of the present disclosure or in the related art, drawings used in the description of the embodiments of the present disclosure or in the related art are briefly described below. Obviously, the drawings as described below are merely some embodiments of the present disclosure. Based on structures illustrated in these drawings, other drawings can be obtained by those skilled in the art without creative effort.

DESCRIPTION OF REFERENCE NUMERALS OF THE ACCOMPANYING DRAWINGS

TABLE 1

Figure 1:
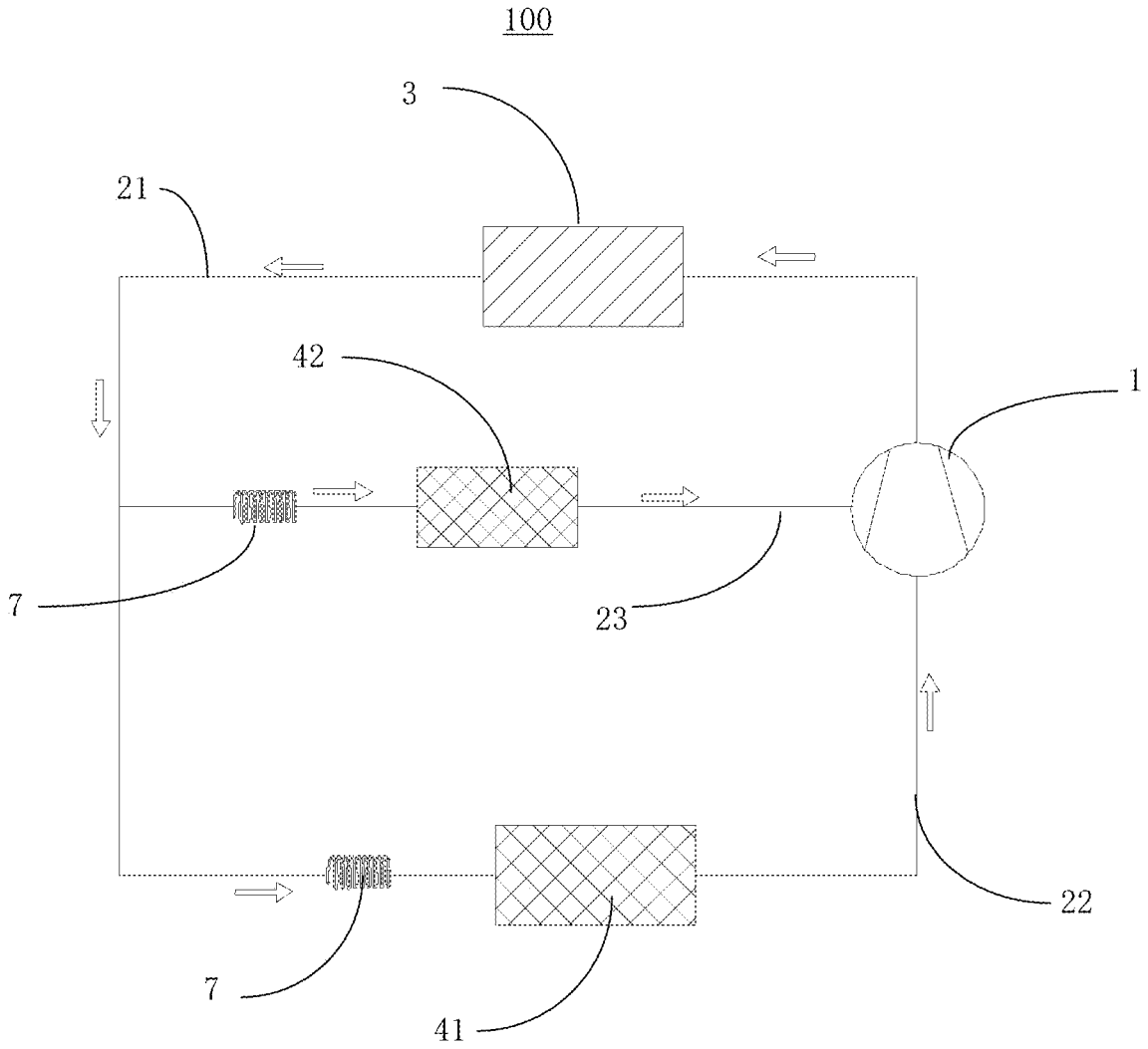
FIG. 1 is a schematic view of a refrigeration system according to an embodiment of the present disclosure.

| Reference Numeral | Name | Reference Numeral | Name |
|---|---|---|---|
| 100 | refrigeration system | 23 | second branch |
| 1 | compressor | 3 | condenser |
| 1a | first suction hole | 41 | first evaporator |
| 1b | second suction hole | 42 | second evaporator |
| 11 | working chamber | 5 | diverter valve |
| 12 | piston | 6 | control valve |
| 13 | second inner suction pipe | 7 | throttling element |
| 14 | inner exhaust pipe | 210 | first outer suction pipe |
| 21 | main flow path | 220 | second outer suction pipe |
| 22 | first branch | 230 | outer exhaust pipe |

The implementations, functional features, and advantages of the present disclosure will be further described in conjunction with the embodiments and with reference to the accompanying drawings.

DETAILED DESCRIPTION OF EMBODIMENTS

Technical solutions according to embodiments of the present disclosure will be described clearly and completely below in combination with accompanying drawings of the embodiments of the present disclosure. Obviously, the embodiments described below are only a part of the embodiments of the present disclosure, rather than all embodiments of the present disclosure. On a basis of the embodiments of the present disclosure, all other embodiments obtained by those skilled in the art without creative labor shall fall within the protection scope of the present disclosure.

It should be noted that if there are directional indications involved in the embodiments of the present disclosure, the directional indications are only used to explain relative positions between various components, movements of various components, or the like under a predetermined posture. When the predetermined posture changes, the directional indications also change accordingly.

In addition, in the embodiments of the present disclosure, if there are descriptions associated with "first", "second", or the like involved in the embodiments of the present disclosure, the descriptions associated with "first", "second", or the like are only used for descriptive purposes, and cannot be understood as indicating or implying relative importance or implicitly indicating the number of indicated technical features. Therefore, the features associated with "first" and "second" may explicitly or implicitly include at least one of the features. Further, combinations can be performed on the technical solutions according to various embodiments, but these combinations must be based on the fact that they can be realized by those skilled in the art. When a combination of the technical solutions is contradictory or unattainable, the combination of the technical solutions neither exists nor falls within the protection scope of the appended claims of the present disclosure.

As global carbon emission restrictions tighten and China faces pressing demands for achieving carbon peaking and carbon neutrality goals, requirements for energy conservation and emission reduction in the refrigeration industry are increasing, and the national energy efficiency standards for various household appliances are also constantly upgrading. Consequently, technical upgrading requirements for household refrigeration systems and devices such as refrigerators and freezers are becoming higher and higher.

Existing refrigeration device, such as a refrigerator and a freezer, and a reciprocating compressor have experienced decades of development, resulting in that the existing refrigeration device has a high degree of technical maturity and a performance level of the existing refrigeration device also tends to bottleneck. Faced with a substantial upgrade of the refrigeration industry in the future, there is a lack of innovative and breakthrough technological progress. A combination manner of a compressor, the most core component and a major energy consumer in a refrigeration system, with other components in the refrigeration system and an overall cycle composition of the system have a great impact on refrigeration performance and an energy efficiency level of a whole machine like a refrigerator and a freezer.

In view of this, the present disclosure provides a refrigeration system and a refrigeration device. The refrigeration system employing a dual-suction compressor and equipped with double evaporators can meet a need for more functions and higher performance. FIG. 1 to FIG. 5 illustrate embodiments of a refrigeration system provided in the present disclosure.

Figure 2:
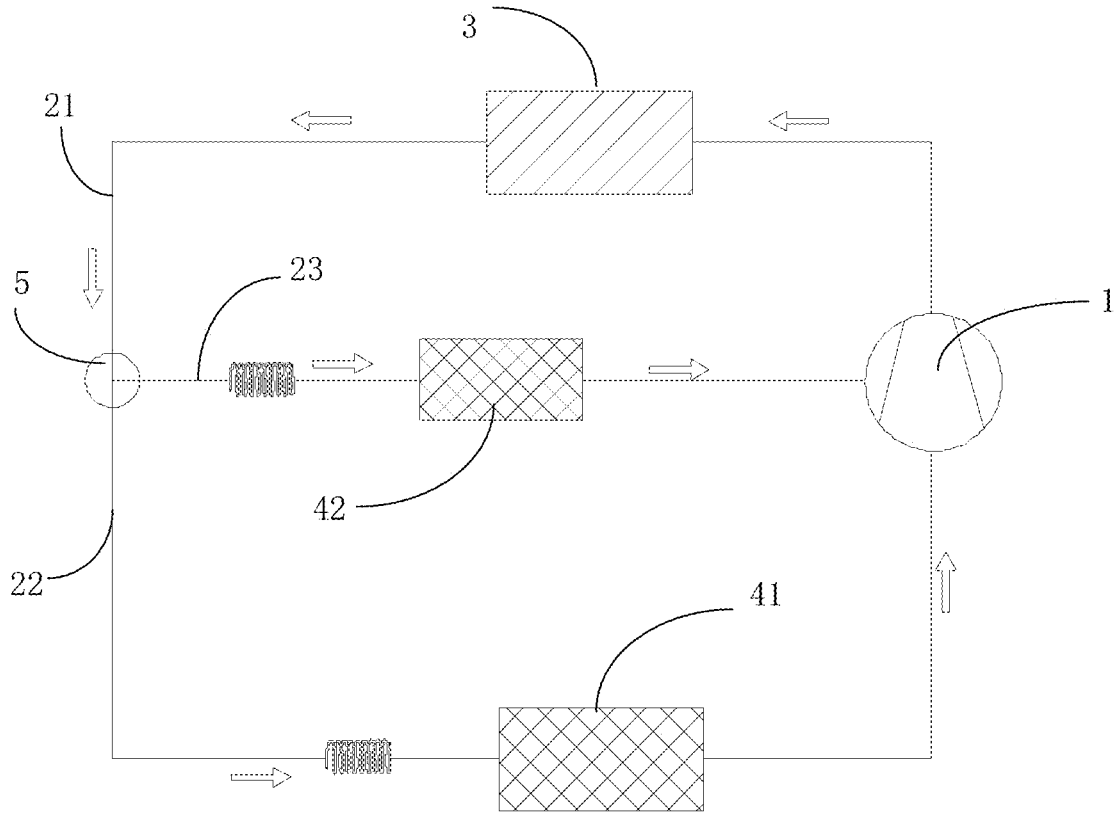
FIG. 2 is a schematic view of the refrigeration system illustrated in FIG. 1 according to another embodiment.

As illustrated in FIG. 1 and FIG. 2, a refrigeration system 100 includes a circulation circuit. The circulation circuit includes a main flow path 21, and a first branch 22 and a second branch 23 that are connected to the main flow path 21 and are connected in parallel. The main flow path 21 is provided with a condenser 3 and a compressor 1. The condenser 3 has an output end in communication with an end of the first branch 22 and an end of the second branch 23.

The compressor 1 has two suction holes in communication with another end of the first branch 22 and another end of the second branch 23, respectively. The first branch 22 and the second branch 23 are provided with a first evaporator 41 and a second evaporator 42, respectively.

In the technical solutions of the present disclosure, the first evaporator 41 and the second evaporator 42 can be independent of each other through two independent suction channels in the compressor 1, and thus an overall efficiency of the refrigeration system 100 becomes higher. Specifically, the first branch 22 and the second branch 23 can realize simultaneous circulation from the first evaporator 41 and the second evaporator 42 under a dual-suction structure of the compressor 1, in such a manner that the first evaporator 41 and the second evaporator 42 having different temperatures operate simultaneously, enhancing a refrigeration capacity of the system. Compared with a conventional refrigeration system having a single-suction single-discharge compressor and series-parallel double evaporators, the refrigeration system 100 of the present disclosure has a larger refrigeration capacity and higher refrigeration performance, better meeting future technical requirements.

Figure 4:
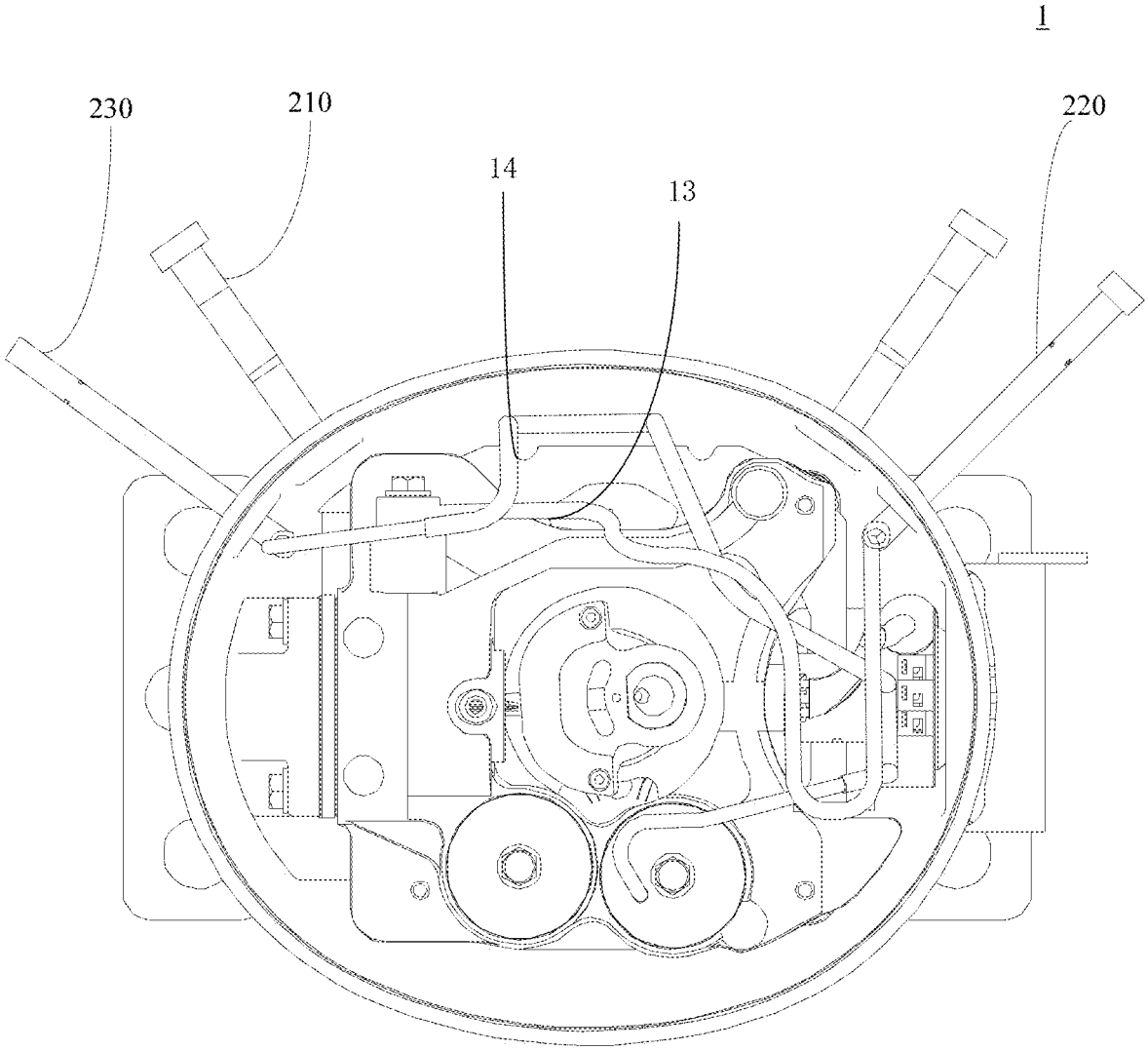
FIG. 4 is a schematic internal structure view of a compressor illustrated in FIG. 1 according to an embodiment.
Figure 5:
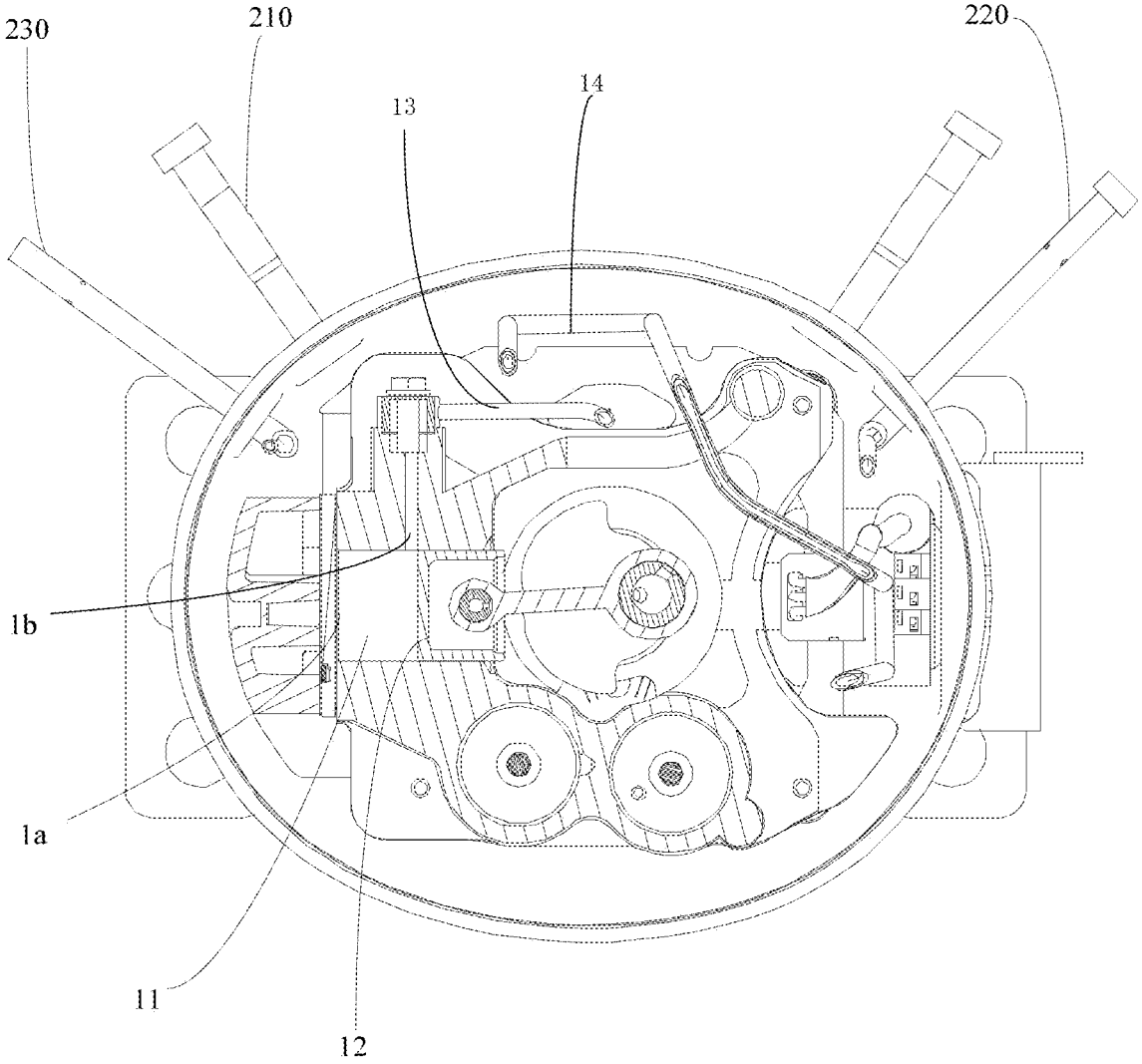
FIG. 5 is a schematic partial cross-sectional view of the compressor illustrated in FIG. 4.

To realize a dual-suction function of the compressor 1, as illustrated in FIG. 4 and FIG. 5, the compressor 1 provided in the present disclosure includes a cylinder body and a piston assembly. The cylinder body has a working chamber 11. The working chamber 11 has a first suction hole 1*a* at a bottom of the working chamber 11 and a second suction hole 1*b* at a side wall of the working chamber 11. The first suction hole 1*a* and the second suction hole 1*b* are in communication with the first branch 22 and the second branch 23, respectively. The piston assembly includes a piston 12 movably disposed in the working chamber 11. The piston 12 has a first dead center at the bottom of the working chamber 11 and a second dead center away from the bottom of the working chamber 11 during an operation stroke of the piston 12. In the compressor 1 provided in the present disclosure, the working chamber 11 is in communication with the first suction hole 1*a* and the second suction hole 1*b* simultaneously, in such a manner that air can be introduced into the working chamber 11 simultaneously through the first branch 22 and the second branch 23 which are in communication with the first suction hole 1*a* and the second suction hole 1*b*, respectively, increasing a suction volume of the working chamber 11. Therefore, a compression energy efficiency of the compressor cylinder is improved. The first suction hole 1*a* and the second suction hole 1*b* are in communication with two flow paths connected in parallel respectively to realize respective working conditions and reduce power consumption. Further, the compressor 1 has advantages of simple structure, low costs, high performance, and satisfactory practicability.

In an exemplary embodiment of the present disclosure, the compressor 1 is a dual-suction compressor. Based on the positions of the first suction hole 1*a* and the second suction hole 1*b* in the working chamber 11, a suction pressure of the first suction hole 1*a* is less than a suction pressure of the second suction hole 1*b*. In this way, the first suction hole 1*a* is in communication with an external piping to form a first suction flow channel having a relatively low airflow pressure, while the second suction hole 1*b* is in communication with an external pipeline to form a second suction flow channel having a relatively higher airflow pressure, which can effectively improve an energy efficiency and reduce the power consumption of the refrigeration system 100. Correspondingly, the first evaporator 41 and the second evaporator 42 correspond to different cold compartments in the refrigeration device and are used for preserving or chilling foods separately. Therefore, considering different evaporation temperatures of different evaporators, the first evaporator 41 in communication with the first suction flow channel having the relatively low airflow pressure should be at a lower temperature, while the second evaporator 42 in communication with the second suction flow channel having the relatively high airflow pressure should be at a higher temperature.

In an exemplary embodiment of the present disclosure, a temperature difference between the first evaporator 41 and the second evaporator 42 is required to be as follows: a temperature of the second evaporator is T1, and a temperature of the first evaporator is T2, where $0 \leq T1 - T2 \leq 25°$ C.

Further, in the present disclosure, the first evaporator 41 is a freezing evaporator, while the second evaporator 42 is a chilled evaporator. Generally speaking, $-15°$ C.$\leq T1 \leq 0°$ C., $-30°$ C.$\leq T2 \leq -15°$ C., and $10 \leq T1 - T2 \leq 20°$ C. Different temperature settings are provided due to different refrigeration requirements of the cold compartments corresponding to the chilled evaporator and the freezing evaporator.

It should be noted that, in an embodiment, the piston assembly further includes a crankshaft and a connection rod. The crankshaft is in a transmission connection with an end of the connection rod. The connection rod is in a transmission connection with the piston 12 at an end of the connection rod away from the crankshaft. Therefore, the crankshaft is configured to drive the connection rod to move under drive of a motor and thus drive the piston 12 to reciprocate in the working chamber 11, completing actions of sucking an airflow and compressing the airflow.

It should be understood that, as an example, in a refrigeration process of a refrigerator, a high-temperature and high-pressure refrigerant gas is transported from the compressor to evaporators corresponding to a freezing compartment and a chilled compartment for evaporation and heat absorption to realize refrigeration of the freezing compartment and the chilled compartment. However, the freezing compartment and the chilled compartment are set at different temperatures, leading to distinct evaporation temperatures for the freezing compartment and the chilled compartment. In this way, the refrigerant has different temperatures and pressures after heat exchange in the freezing compartment and the chilled compartment. In this embodiment, the first evaporator 41 and the second evaporator 42 correspond to the freezing compartment and the chilled compartment, respectively. In addition, in the related art, the compressor realizes refrigeration functions of freezing and chilling through one flow path. In this way, no matter whether the freezing compartment or the chilled compartment requires refrigeration, the whole heat exchange system needs to participate in the operation, leading to large energy consumption and a low energy efficiency.

In a conventional compressor, exposure and covering of each suction hole are usually controlled by a control valve assembly. When the compressor has only one suction hole, one control valve assembly is set. When the compressor has a plurality of suction holes, normally a plurality of control valve assemblies is set correspondingly, which leads to cumbersome control. Therefore, in an embodiment of the present disclosure, a distance between the second suction hole 1*b* and the first dead center is L, and a distance between the first dead center and the second dead center is S, where $0.5S < L$. During an operation stroke of the piston 12, exposure and covering states of the first suction hole 1*a* and the second suction hole 1*b* are as follows.

A suction stroke of the compressor 1 includes a first stroke and a second stroke.

In the first stroke, the piston 12 moves from the first dead center to the second dead center and is at a distance of less than 0.5S from the first dead center. During the first stroke, the control valve assembly is opened, in such a manner that the first suction hole 1*a* is exposed while the second suction hole 1*b* is blocked by the piston 12. In this case, the working chamber 11 achieves suction only through the first suction hole 1*a*, and all refrigerant in the working chamber 11 comes from the refrigerant of the first suction hole 1*a*. It should be understood that, when the piston 12 moves towards the second dead center, a compression space of the working chamber 11 increases, and the working chamber 11 is in a negative pressure state, which facilitates entry of an external airflow from the first suction hole 1*a* to the working chamber 11. However, since a pressure of the airflow passing through the first suction hole 1*a* is smaller than a pressure of the airflow passing through the second suction hole 1*b*, the second suction hole 1*b* is blocked by the piston 12 during the operation stroke to prevent the airflow from the second suction hole 1*b* from blocking entry of the airflow from the first suction hole 1*a* into the working chamber 11.

In the second stroke, the piston 12 moves from the first dead center to the second dead center and is at a distance of greater than 0.5S from the first dead center. During the second stroke, the second suction hole 1*b* is unblocked by the piston 12, which enables the second suction hole 1*b* to be in communication with the working chamber 11. In this case, the control valve assembly is switched between an open state and a closed state as desired. When the control valve assembly is in the open state, the airflow is introduced to the working chamber 11 through the first suction hole 1*a* and the second suction hole 1*b* simultaneously. During the first stroke, a predetermined amount of airflow is sucked into the compression space of the working chamber 11 through the first suction hole 1*a*, in such a manner that the compression space has a predetermined airflow pressure. Therefore, when the airflow is introduced to the working chamber 11 through the second suction hole 1*b*, little impact is exerted on the airflow from the first suction hole 1*a*. Moreover, since the distance from the second suction hole 1*b* to the first dead center is greater than 0.5S, i.e., the distance from the second suction hole 1*b* to the first suction hole 1*a* is greater than 0.5S, a proper buffer distance exists between the second suction hole 1*b* and the first suction hole 1*a*, mitigating an obstruction effect of the airflow from the second suction hole 1*b* on the airflow from the first suction hole 1*a*, and improving the compression energy efficiency. When the control valve assembly is in the closed state, the airflow is introduced to the working chamber 11 through the second suction hole 1*b*. In this case, the refrigerant supplied into the working chamber 11 comes from the second suction hole 1*b*. It should be understood that, as a distance from the second suction hole 1*b* to a midpoint between the first dead center and the second dead center decreases, an exposure time point of the second suction hole 1*b* becomes earlier and a covering time point of the second suction hole 1*b* becomes later. Consequently, the high-pressure refrigerant is supplied through the corresponding flow path for a longer duration, resulting in a greater volume of gas supply. As a distance from the second suction hole 1*b* to the second dead center becomes smaller, the exposure time point of the second suction hole 1*b* becomes later, and the covering time point of the second suction hole 1*b* becomes earlier. Consequently, the high-pressure refrigerant is supplied through the corresponding flow path for a shorter duration, resulting in a smaller volume of gas supply. In reality, the position of the second suction hole 1*b* may be set based on a demand of the volume of gas supply.

A compression stroke of the compressor 1 includes a third stroke and a fourth stroke.

In the third stroke, the piston 12 moves from the second dead center towards the first dead center and is at a distance of greater than 0.5S from the first dead center. During the third stroke, the control valve assembly is closed, and the piston 12 moves rapidly towards the first dead center. In this case, the airflow is still introduced to the working chamber 11 through the second suction hole 1*b*, and the refrigerant supplied into the working chamber 11 comes from the second suction hole 1*b*. Therefore, when the airflow in the working chamber 11 is compressed during the third stroke, the airflow introduced into the working chamber 11 through the second suction hole 1*b* is prevented from being excessively impeded, enabling the compressor 1 to still suck in the airflow during the compression stroke. In addition, since the working chamber 11 contains a mixture of the airflow from the first suction hole 1*a* and the airflow from the second suction hole 1*b*, the airflow pressure in the working chamber 11 is lower than the airflow pressure of the airflow passing through the second suction hole.

In the fourth stroke, the piston 12 moves from the second dead center towards the first dead center and is at a distance of less than 0.5S from the first dead center. During the fourth stroke, the control valve assembly is still closed and the second suction hole 1*b* is blocked by the piston 12. During the fourth stroke, the piston 12 compresses the airflow in the working chamber 11 into a high-pressure airflow. When the piston 12 moves to the second dead center, the airflow pressure in the working chamber 11 is compressed to a predetermined level. Therefore, the control valve assembly in communication with an output pipe of the working chamber 11 is switched from the closed state to the open state to output the compressed high-pressure airflow.

In addition, in this embodiment, the compressor 1 further includes a housing, a first outer suction pipe 210, a second outer suction pipe 220, and a second inner suction pipe 13 in communication with the second outer suction pipe 220. The first outer suction pipe 210 and the second outer suction pipe 220 are arranged outside the housing. The second inner suction pipe 13 is arranged at an inner side the housing. In an exemplary embodiment of the present disclosure, the first outer suction pipe 210 and the second outer suction pipe 220 are in communication with the first suction hole 1*a* and the second suction hole 1*b*. The compressor 1 is disposed in an inner cavity of the housing. The second inner suction pipe 13 is connected to an end of the second outer suction pipe 220 disposed at the housing to form the second suction flow channel. The first suction flow channel is formed by the first outer suction pipe 210 correspondingly.

Operation circuits corresponding to two refrigeration flow paths are as follows.

A flow path of the airflow in the first suction flow channel is: first refrigeration flow path→first suction hole 1*a*→working chamber 11.

A flow path of the airflow in the second suction flow channel is: second refrigeration flow path→second suction hole 1*b*→working chamber 11.

The compressor 1 further includes an inner exhaust pipe 14 in communication with the working chamber 11. The inner exhaust pipe 14 is in communication with an outer exhaust pipe 230 of the compressor 1 to exhaust the compressed high-pressure airflow in the working chamber 11 from the inner exhaust pipe 14 to the outer exhaust pipe 230.

In a specific implementation, the first refrigeration flow path corresponds to a freezing compartment of a refrigerator. Since the freezing compartment requires a relatively large refrigeration capacity, a relatively large refrigerant volume is required. Consequently, during operation, a refrigerant pressure consumed by the freezing compartment is also relatively large. The second refrigeration flow path corresponds to a chilled compartment of the refrigerator. Since the chilled compartment requires a relatively small refrigeration capacity, a refrigerant pressure consumed by the chilled compartment is also relatively small. In this way, the pressure returned to the first suction hole 1*a* is much smaller than that at the second suction hole 1*b*. However, the relatively large refrigerant volume is required by the first refrigeration flow path. Therefore, when the compressor 1 is in operation, the first suction hole 1*a* is mainly exposed by means of the piston 12 during the first major part of the suction stroke to implement primary suction, for sucking in the relatively large refrigerant volume in the refrigeration flow path corresponding to the freezing compartment. During the latter minor part of the suction stroke, the second suction hole 1*b* is in communication with the working chamber 11 while the first suction hole 1*a* is covered, allowing the high-pressure refrigerant gas to be supplemented through the second suction hole 1*b*. In addition, the gas is continued to be supplemented during the first minor part of the compression stroke. Finally, during the latter major part of the compression stroke, the second suction hole 1*b* is covered, and the refrigerant in the working chamber 11 is compressed by the piston 12. By setting the distance between the second suction hole 1*b* and the first dead center and the distance between the second suction hole 1*b* and the second dead center, a gas intake volume through the second suction hole 1*b* can be controlled. That is, the position of the second suction hole 1*b* enables the piston 12 to adjust an exposure duration and a covering duration of the second suction hole 1*b* during a reciprocating movement of the piston 12. Therefore, a flow ratio between the first suction hole 1*a* and the second suction hole 1*b* can be adjusted. In addition, by forming the second suction hole 1*b* at a side wall of the cylinder body and close to the second dead center, the second suction hole 1*b* can be exposed or covered automatically during the operation stroke of the piston 12, without specially setting up the control valve assembly at the compressor 1 to control the exposure and the covering of the second suction hole 1*b*. Such a structure is ingenious in design and cost-effective.

It should be noted that, the distance between the first dead center and the second dead center is S. That is, the first dead center refers to a position where an end of the piston 12 close to a bottom wall of the cylinder body is located when an end face of an end of the piston 12 close to a bottom of the working chamber 11 moves to a position at a shortest distance from the bottom wall of the cylinder body. The second dead center refers to a position where an end of the piston 12 close to the bottom wall of the cylinder body is located when an end face of an end of the piston 12 close to the bottom wall of the cylinder body moves to a position at a greatest distance from the bottom of the working chamber 11. That is, the distance S is a distance between two limit states of the end face of the piston 12 close to the bottom wall of the cylinder body. The distance between the second suction hole 1*b* and the first dead center is L. That is, a distance between a center line of the second suction hole 1*b* and the first dead center is L.

It should be noted that, a shock-absorbing pipe segment may be formed in the second inner suction pipe 13. An inner wall surface of the shock-absorbing pipe segment has a concave-convex structure in a length direction of the second inner suction pipe 13. With the concave-convex structure in the second inner suction pipe, a sound wave generated by the high-pressure gas passing through the second inner suction pipe 13 may undergo an abrupt change at a cross section of the pipe in a flowing direction and may be reflected by the concave-convex structure. Therefore, part of the forward-propagating sound wave returns to a starting point and then redirects forward again. The starting point converges with the second forward-propagating sound wave that has not yet been reflected, both of which are equal in amplitude but differ in phase by an odd multiple of 180 degrees. Consequently, the starting point and the second forward-propagating sound wave that has not yet been reflected interfere with each other and cancel out, achieving an effect of shock absorption and noise reduction.

The throttling element is one of the basic components of a compression refrigeration system. A function of the throttling element is to depressurize a high-pressure refrigerant liquid from the condenser 3 into a low-pressure low-temperature refrigerant, which then enters the evaporator for evaporation and heat absorption. The throttling element mainly includes a capillary tube, a throttling short tube, a thermal expansion valve, an electronic expansion valve, a float valve, etc. In an embodiment, the refrigeration system 100 further includes two throttling elements 7 disposed at the first branch 22 and the second branch 23, respectively. One of the two throttling elements 7 is located between the corresponding condenser 3 and the first evaporator 41, while another of the two throttling elements 7 is located between the corresponding condenser 3 and the second evaporator 42, to realize functions of the two throttling elements 7. It should be noted that, specific types of the two throttling elements 7 are not limited in the present disclosure. The two throttling elements 7 may be configured to be the same or designed differently.

To facilitate control of selective opening and closing of the first branch 22 and the second branch 23, as illustrated in FIG. 2, the refrigeration system 100 further includes a diverter valve 5. The diverter valve 5 is disposed at a connection between the first branch 22, the second branch 23, and the main flow path 21. The diverter valve 5, also known as a speed synchronization valve, is a generic term for the diverter valve 5, a collector valve, a one-way diverter valve 5, a one-way collector valve, and a proportional diverter valve 5, and has many advantages, such as simple structure, low costs, easy manufacture, and high reliability, leading to widespread applications in hydraulic systems. A design of the diverter valve 5 can synchronize flow speeds of liquids diverted from the main flow path 21 into the first branch 22 and the second branch 23. Meanwhile, the diverter valve 5 may make one of the branches be in a closed state to control communication and blocking of the first branch 22 and the second branch 23 based on actual operation states.

Figure 3:
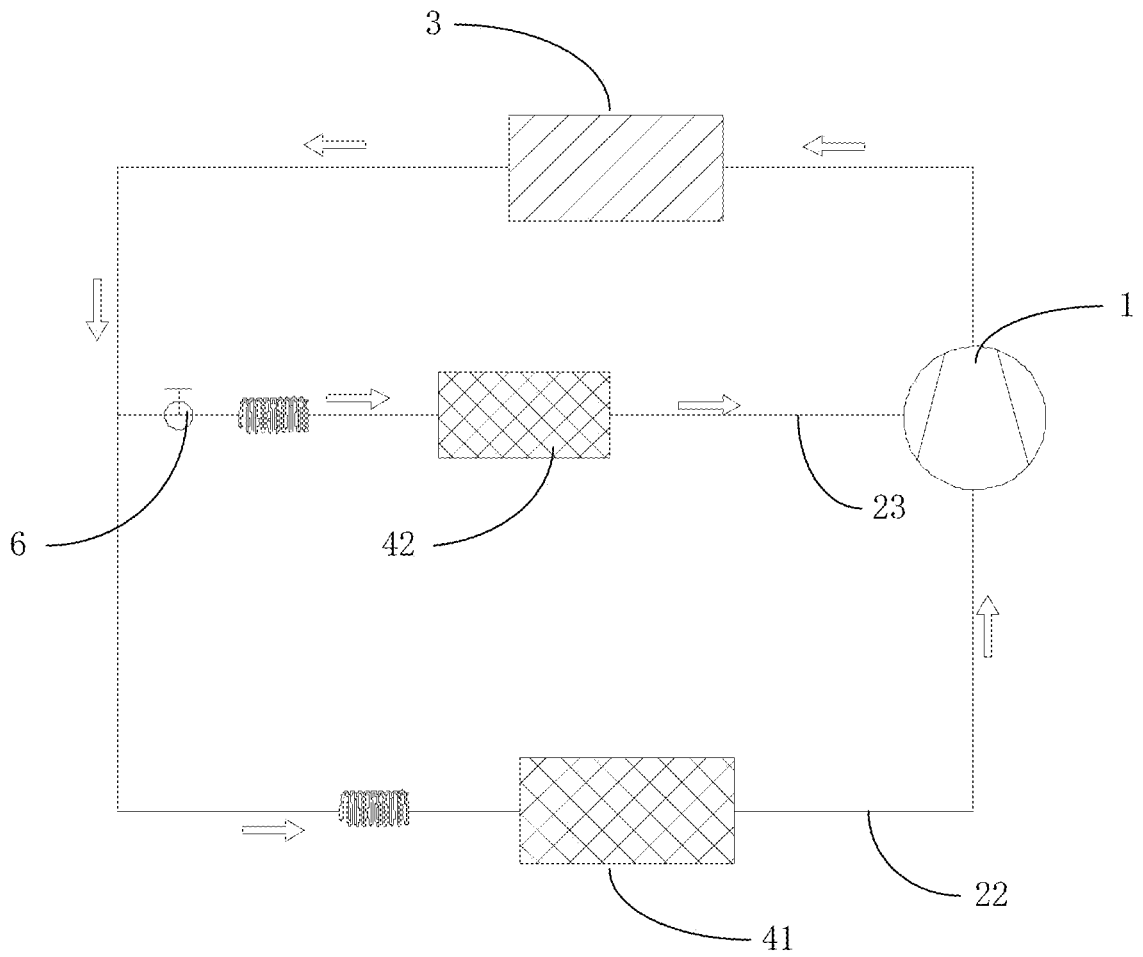
FIG. 3 is a schematic view of the refrigeration system illustrated in FIG. 1 according to yet another embodiment.

In other embodiments, as illustrated in FIG. 3, the second branch 23 is provided with a control valve 6. In this case, the first branch 22 is in a constant connected state, while the second branch 23 may be selectively connected or disconnected under control of the control valve 6, achieving different operation states. In addition, the control valve 6 may also be disposed at the first branch 22 alone, or at each of the first branch 22 and the second branch 23, enabling automatic connection and disconnection of each branch.

In an exemplary embodiment of the present disclosure, the refrigeration system 100 in this embodiment has the following structure.

The main flow path 21 is provided with a dual-suction reciprocating compressor and the condenser 3. The first branch 22 and the second branch 23 are respectively provided with the freezing evaporator and the chilled evaporator and are respectively in communication with the first suction hole 1*a* and the second suction hole 1*b* of the dual-suction reciprocating compressor. The first suction hole 1*a* and the second suction hole 1*b* are in communication with the first outer suction pipe 210 and the second outer suction pipe 220 which are independent from each other. The suction pressure of the second suction hole 1*b* is greater than the suction pressure of the first suction hole 1*a*. A throttling element 7 located at the first branch 22 is disposed between the condenser 3 and the first evaporator 41. A throttling element 7 located at the second branch 23 is disposed between the condenser 3 and the second evaporator 42. The diverter valve 5 is disposed at the connection between the first branch 22, the second branch 23, and the main flow path 21. Therefore, the refrigeration system 100 has different operation states. With the two mutually independent suction channels having different suction pressures formed by the dual-suction reciprocating compressor, the chilled evaporator and the freezing evaporator can operate independently at different evaporation temperatures. Compared with the refrigeration system in the related art, the refrigeration system 100 has improved chilling and evaporation temperatures, a higher overall efficiency, a larger refrigeration capacity, and higher refrigeration performance, better meeting the future technical requirements. Moreover, the dual-suction reciprocating compressor and the refrigeration system 100 are relatively simple and low in costs and have better practicability.

In the technical solutions provided in the present disclosure, the first branch 22 and the second branch 23 correspond to a freezing refrigeration flow path and a chilled refrigeration flow path, respectively. That is, the high-temperature and high-pressure refrigerant compressed by the compressor 1 can be reasonably distributed to the freezing refrigeration flow path and the chilled refrigeration flow path. The high-temperature and high-pressure refrigerant compressed by the compressor 1 returns to the compressor 1 at a relatively low temperature and a relatively low pressure after passing through the first evaporator 41 corresponding to the freezing compartment. The high-temperature and high-pressure refrigerant compressed by the compressor 1 returns to the compressor 1 at a relatively high temperature and a relatively high pressure after passing through the second evaporator 42 corresponding to the chilled compartment. The working chamber 11 of the cylinder body is configured to be concurrently in communication with the first suction hole 1*a* and the second suction hole 1*b* to enable passage through the first suction flow channel corresponding to the first suction hole 1*a* and passage through the second suction flow channel corresponding to the second suction hole 1*b*. In this way, the refrigerant at the relatively low temperature and the relatively low pressure returned from the freezing compartment is supplied into the cylinder body of the compressor 1 through the first suction hole 1*a*, while the refrigerant at the relatively high temperature and the relatively high pressure returned from the chilled compartment is supplied to the compressor 1 through the second suction hole 1*b*. In this way, when the refrigerant gas supplied through the first suction hole 1*a* is compressed by the cylinder body, the gas can be supplemented into the working chamber 11 through the second suction hole 1*b*, which increases the suction volume of the working chamber 11 of the cylinder body, improving the compression energy efficiency of the compressor 1.

The present disclosure further provides a refrigeration device, which includes the above-mentioned refrigeration system 100. The refrigeration device includes all the technical features of the above-mentioned refrigeration system 100. Therefore, the refrigeration device also has the technical effects brought by all the technical features of the above-mentioned refrigeration system 100, and thus details thereof are omitted here. It should be noted that the refrigeration device may be a refrigerator, a freezer, a chill box, etc. The present disclosure is not limited in this regard. In this embodiment, the refrigeration device is a refrigerator.

Although some embodiments of the present disclosure are described above, the scope of the present disclosure is not limited to the embodiments. Any equivalent structure transformation made using the contents of the specification and the accompanying drawings, or any direct or indirect application of the contents of the specification and the accompanying drawings in other related fields, without departing from the concept of the present disclosure shall equally fall within the scope of the present disclosure.

What is claimed is:

1. A refrigeration system comprising:

a circulation circuit comprising:

a main flow path; and a first branch and a second branch that are connected to the main flow path and are connected in parallel, wherein:

the main flow path is provided with a condenser and a compressor;

the condenser having an output end in communication with an end of the first branch and an end of the second branch;

the compressor having two suction holes in communication with another end of the first branch and another end of the second branch, respectively; and the first branch and the second branch are provided with a first evaporator and a second evaporator, respectively, and wherein the compressor comprises:

a cylinder body having a working chamber, the working chamber having a first suction hole at a bottom of the working chamber and a second suction hole at a side wall of the working chamber, and the first suction hole and the second suction hole being in communication with the first branch and the second branch, respectively; and a piston assembly comprising a piston movably disposed in the working chamber, the piston having a first dead center at the bottom of the working chamber and a second dead center away from the bottom of the working chamber during an operation stroke of the piston, wherein a distance between the second suction hole and the first dead center is L, and a distance between the first dead center and the second dead center is S, where $0.5S<L$.

2. The refrigeration system according to claim 1, wherein:

a suction pressure of the first suction hole is less than a suction pressure of the second suction hole; and a temperature of the first evaporator is lower than a temperature of the second evaporator.

3. The refrigeration system according to claim 1, wherein a temperature of the second evaporator is T1, and a temperature of the first evaporator is T2, where $0 \leq T1 - T2 \leq 25°$ C.

4. The refrigeration system according to claim 3, wherein $-15°$ C.$\leq T1 \leq 0°$ C., $-30°$ C.$\leq T2 \leq -15°$ C., and $10 \leq T1 - T2 \leq 20°$ C.

5. The refrigeration system according to claim 1, wherein the refrigeration system further comprises at least one diverter valve disposed at a connection between the first branch, the second branch, and the main flow path.

6. The refrigeration system according to claim 1, wherein at least one of the first branch and the second branch is provided with a control valve.

7. The refrigeration system according to claim 1, further comprising two throttling elements disposed at the first branch and the second branch, respectively, one of the two throttling elements being located between the condenser and the first evaporator, and another of the two throttling elements being located between the condenser and the second evaporator.

8. The refrigeration system according to claim 7, wherein each of the two throttling elements is a capillary tube or an expansion valve.

9. A refrigeration device comprising the refrigeration system according to claim 1.

10. The refrigeration device according to claim 9, wherein the refrigeration device comprises a refrigerator.

* * * * *